US009196193B2

(12) United States Patent
Jang et al.

(10) Patent No.: US 9,196,193 B2
(45) Date of Patent: Nov. 24, 2015

(54) DISPLAY DEVICE INCLUDING RGBW SUB-PIXELS AND METHOD OF DRIVING THE SAME

(71) Applicant: Samsung Display Co., Ltd., Yongin, Gyeonggi-Do (KR)

(72) Inventors: Won-Woo Jang, Yongin (KR); Jong-Woong Park, Yongin (KR)

(73) Assignee: Samsung Dislay Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 164 days.

(21) Appl. No.: 13/773,257

(22) Filed: Feb. 21, 2013

(65) Prior Publication Data

US 2014/0118411 A1 May 1, 2014

(30) Foreign Application Priority Data

Oct. 26, 2012 (KR) ..... 10-2012-0119797

(51) Int. Cl.

*G09G 5/10* (2006.01)
*G09G 3/32* (2006.01)
*G09G 3/20* (2006.01)

(52) U.S. Cl.

CPC ..... *G09G 3/3208* (2013.01); *G09G 3/2003* (2013.01); *G09G 2300/0452* (2013.01); *G09G 2340/06* (2013.01); *G09G 2360/16* (2013.01)

(58) Field of Classification Search

USPC ..... 345/83
See application file for complete search history.

(56) References Cited

U.S. PATENT DOCUMENTS

| | | | | |
|---|---|---|---|---|
| 5,929,843 | A * | 7/1999 | Tanioka | 345/600 |
| 7,742,026 | B2 | 6/2010 | Lee et al. | |
| 7,839,418 | B2 * | 11/2010 | Kwon | 345/604 |
| 2006/0221100 | A1 * | 10/2006 | Kao et al. | 345/690 |
| 2009/0128694 | A1 * | 5/2009 | Yang et al. | 348/453 |
| 2011/0007100 | A1 * | 1/2011 | Yoshida | 345/690 |
| 2011/0292087 | A1 | 12/2011 | Lim | |
| 2012/0001947 | A1 * | 1/2012 | Chu-Ke et al. | 345/690 |
| 2013/0070007 | A1 * | 3/2013 | Park et al. | 345/694 |
| 2013/0120472 | A1 * | 5/2013 | Byun et al. | 345/690 |

FOREIGN PATENT DOCUMENTS

| | | | |
|---|---|---|---|
| KR | 10-2007-0011830 | A | 1/2007 |
| KR | 10-2008-0061772 | A | 7/2008 |
| KR | 10-2009-0078219 | A | 7/2009 |
| KR | 10-2011-0130126 | A | 12/2011 |

* cited by examiner

*Primary Examiner* — Alexander Eisen
*Assistant Examiner* — Kebede Teshome
(74) *Attorney, Agent, or Firm* — Robert E. Bushnell, Esq.

(57) ABSTRACT

A display device includes a data mapping unit for extracting a minimum value among three-color input data which respectively correspond to red, green, and blue, determining white color output data by multiplying the extracted minimum value by a gain ratio, and determining red, green, and blue color output data respectively by subtracting the white color output data from the three-color input data; and a gain adjustment unit for determining the gain ratio to minimize a standard deviation respectively for the white color output data and the red, green, and blue color output data.

16 Claims, 5 Drawing Sheets

DISPLAY DEVICE INCLUDING RGBW SUB-PIXELS AND METHOD OF DRIVING THE SAME

CLAIM PRIORITY

This application makes reference to, incorporates the same herein, and claims all benefits accruing under 35 U.S.C. §119 from and application for DISPLAY DEVICE INCLUDING RGBW SUB-PIXELS AND METHOD OF DRIVING THE SAME earlier filed in the Korean Intellectual Property Office on 26 Oct. 2012 and there duly assigned Serial No. 10-2012-0119797.

BACKGROUND OF THE INVENTION

1. Field of the Invention

The present invention relates to a display device, and more particularly, to a display device including red, green, blue, and white (RGBW) sub-pixels.

2. Description of the Related Art

Recently, in the field of organic light-emitting diode (OLED) displays, white organic light-emitting diode (WOLED) technology that provides an advantage for manufacturing a large high-resolution OLED display has been on the spotlight, instead of conventional R/G/B OLED technology. A WOLED display includes an additional sub-pixel for white color, and thus, white color data may be implemented without having to use a color filter for an RGB signal. Additionally, as a color filter is not used for color implementation, a decrease in luminous intensity of the WOLED display is not generated.

Two different methods may be used to implement white color, when a display panel of a WOLED display device which uses an RGBW sub-pixel is driven. That is, white color may be implemented by a white sub-pixel without having to use a color filter. Besides, white color may also be implemented by combining red, green, and blue colors which are implemented through an RGB color filter.

SUMMARY OF THE INVENTION

The present invention provides a display device for optimizing a trade-off relationship between a life cycle and power consumption by implementing white color when a white organic light-emitting diode (WOLED) display is driven.

According to an aspect of the present invention, there is provided a display device including a data mapping unit for extracting a minimum value among three-color input data which respectively correspond to red, green, and blue, determining white color output data by multiplying the extracted minimum value by a gain ratio, and determining red, green, and blue color output data respectively by subtracting the white color output data from the three-color input data; and a gain adjustment unit for determining the gain ratio to minimize a standard deviation respectively for the white color output data and the red, green, and blue color output data.

The gain adjustment unit may determine gain ratios for each unit pixel included in the display device. The gain adjustment unit may determine gain ratios for each frame of displayed images. The gain adjustment unit may receive the three-color input data, change test gain ratios, calculate expected color output data for red, green, blue, and white for each test gain ratio, obtain a standard deviation for the calculated expected color output data, and determine a test gain ratio, for minimizing a standard deviation for the calculated expected color output data, as a gain ratio of a corresponding pixel.

The test gain ratio may be changed in the range from 0 to 1 by a step value. The display device may further include a unit pixel which includes red, green, blue, and white sub-pixels and include a display unit for displaying images which correspond to the white color output data and the red, green, and blue color output data.

According to another aspect of the present invention, there is provided a method of driving a display device including red, green, blue, and white sub-pixels, a gain adjustment unit, and a data mapping unit, including receiving, by the gain adjustment unit, three-color input data which respectively correspond to red, green, and blue; determining, by the gain adjustment unit, a gain ratio for minimizing a standard deviation respectively for white, red, green, and blue color output data; and converting, by a data mapping unit, the three-color input data which respectively correspond to red, green, and blue into four color input data which respectively correspond to white, red, green, and blue, through the determined gain value.

The converting of three-color input data into four color input data may include extracting a minimum value among three-color input data which respectively correspond to red, green, and blue; determining white color output data by multiplying the extracted minimum value by the gain ratio; and determining red, green, and blue color output data respectively by subtracting the white color output data from the three-color input data.

Display panel may display images which respectively correspond to the white color output data and the red, green, and blue color output data.

The gain adjustment unit may determine gain ratios for each unit pixel included in display panel.

The gain adjustment unit may determine gain ratios for each frame of displayed images.

The determining of the gain ratio may include changing test gain ratios and calculating expected color output data respectively for red, green, blue, and white colors for each test gain ratio; obtaining a standard deviation for the calculated expected output data; and determining a test gain ratio, for minimizing a standard deviation for the calculated expected color output data, as a gain ratio of a corresponding pixel.

The test gain ratio may be changed in the range from 0 to 1 by a step value.

According to another aspect of the present invention, there is provided a display device including a display panel which includes a plurality of unit pixels each including red, green, blue, and white sub-pixels; a data driver which supplies four color data signals, which correspond to red, green, blue, and white color output data, respectively to the plurality of unit pixels; a gate driver which supplies a gate-on voltage to the plurality of unit pixels; and a timing controller which controls driving of the data driver and the gate driver and supplies white color output data and red, green, and blue color output data of each sub-pixel to the data driver, wherein the timing controller includes a data mapping unit for extracting a minimum value among three-color input data which respectively correspond to red, green, and blue, determining white color output data by multiplying the extracted minimum value by a gain ratio, and determining red, green, and blue color output data respectively by subtracting the white color output data from the three-color input data; and a gain adjustment unit for determining the gain ratio to minimize a standard deviation respectively for the white color output data and the red, green, and blue color output data.

The gain adjustment unit may receive the three-color input data, change test gain ratios, calculate expected color output data for red, green, blue, and white for each test gain ratio, and obtain a standard deviation for the calculated expected color output data, and determine a test gain ratio, for minimizing a standard deviation for the calculated expected color output data, as a gain ratio of a corresponding pixel.

The display panel may display images which correspond to the white color output data and the red, green, and blue color output data

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
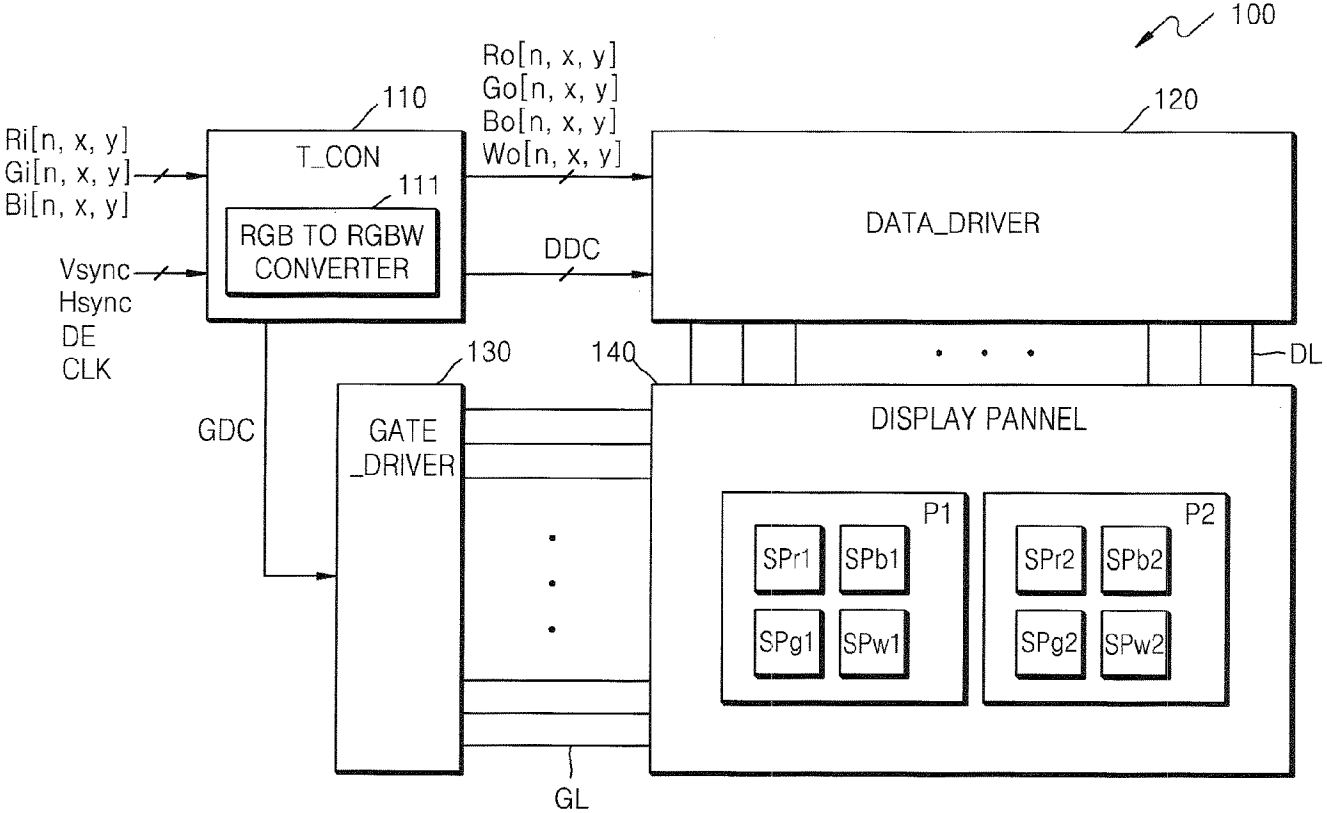
FIG. 1 is a block diagram illustrating a display device according to an embodiment of the present invention.

Hereinafter, the present invention will be described in detail by explaining exemplary embodiments of the invention with reference to the attached drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. It should be understood, however, that there is no intent to limit example embodiments to the particular forms disclosed, but on the contrary, example embodiments are to cover all modifications, equivalents, and alternatives falling within the scope of the invention. Like numbers refer to like elements throughout the description of the figures. In the drawings, the lengths and sizes of layers and regions are exaggerated for clarity.

The terminology used herein is for the purpose of describing particular embodiments only and is not intended to be limiting of example embodiments. As used herein, the singular forms "a", "an", and "the" are intended to include the plural forms as well, unless the context clearly indicates otherwise. It will be further understood that the terms "comprises", "comprising", "includes", and/or "including" when used herein, specify the presence of stated features, integers, steps, operations, elements, and/or components, but do not preclude the presence or addition of one or more other features, integers, steps, operations, elements, components, and/or groups thereof.

It will be understood that, although the terms 'first', 'second', etc. may be used herein to describe various elements, these elements should not be limited by these terms. These terms are only used to distinguish one element from another. For example, a first element could be termed a second element, and, similarly, a second element could be termed a first element, without departing from the scope of example embodiments.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating a display device 100 according to an embodiment of the present invention.

Referring to FIG. 1, the display device 100 may include a display panel 140, a timing controller 110, a data driver 120, and a gate driver 130.

In the display panel 140, a plurality of data lines DL and a plurality of gate lines GL cross each other. A plurality of pixels P1 and P2 that include four sub-pixels respectively are disposed on areas of the display panel 140 in which the data lines DL and the gate lines GL cross. The pixels P1 may each include an R sub-pixel SPr1 for generating red (R) light, a G sub-pixel SPg1 for generating green (G) light, a B sub-pixel SPb1 for generating blue (B) light, and a W sub-pixel SPw1 for generating white (W) light. Similarly, the pixels P2 may each include an R sub-pixel SPr2, a G sub-pixel SPg2, a B sub-pixel SPb2, and a W sub-pixel SPw2.

FIG. 1 illustrates only two pixels for convenience of explanation. However, the number of pixels included in the display device 140 may vary according to applications. FIG. 1 will be further explained below.

Figure 2A:
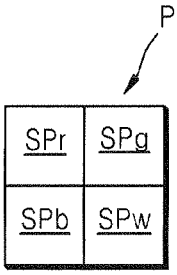
FIGS. 2A-2C are diagrams illustrating various layouts of sub-pixels in a pixel according an embodiment of the present invention.
Figure 2B:
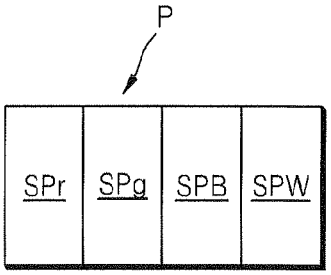
Figure 2C:
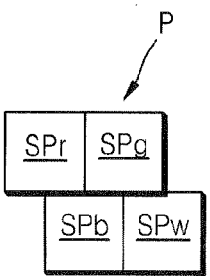

FIGS. 2A-2C are diagrams illustrating various layouts of sub-pixels in a pixel according an embodiment of the present invention.

Referring to FIG. 2A, sub-pixels in one pixel P may form a checkered pattern, by crossing of two data lines and two gate lines. Additionally, sub-pixels in a pixel P may also form a striped pattern, by crossing of four data lines and one gate line, as shown in FIG. 2B. Also, as shown in FIG. 2C, sub-pixels in a pixel P may also form a misaligned checkered pattern, by crossing of two data lines and two gate lines. In FIG. 2C, sub-pixels SPr and SPg in an upper row are misaligned with sub-pixels SPb and SPw in a lower row.

Figure 3:
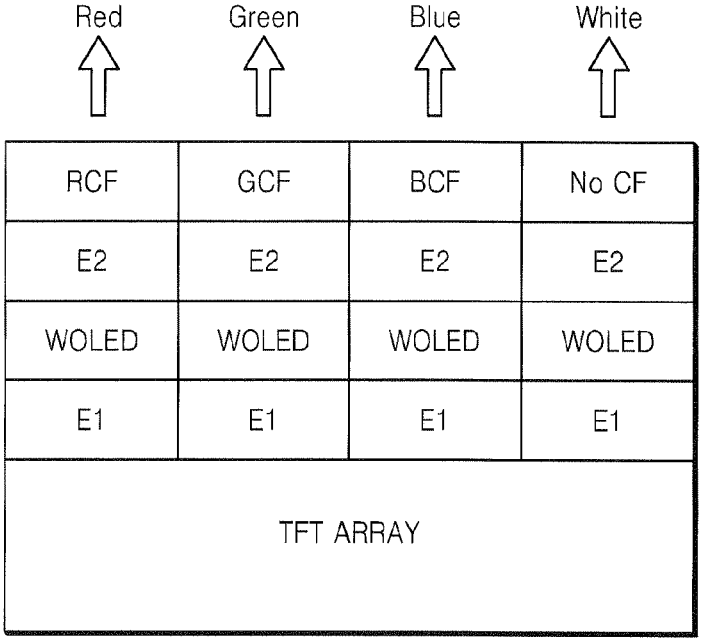
FIG. 3 is a diagram illustrating a laminated structure of sub-pixels in a pixel according an embodiment of the present invention.

FIG. 3 is a diagram illustrating a laminated structure of sub-pixels in a pixel according an embodiment of the present invention.

Referring to FIG. 3, sub-pixels SPr, SPg, SPb, and SPw respectively include white organic light-emitting diodes (WOLEDs). The WOLED has a structure in which an R emission layer, a G emission layer, and a B emission layer are selectively laminated between a cathode electrode and an anode electrode. The WOLED is formed for each sub-pixel.

As shown in FIG. 3, the R sub-pixel SPr includes an R color filter RCF for transmitting only red light among white light incident from the WOLED. The G sub-pixel SPg includes a G color filter GCF for transmitting only green light among white light incident from the WOLED. The B sub-pixel SPb includes a B color filter BCF for transmitting only blue light among white light incident from the WOLED. The W sub-pixel SPw does not include a color filter, and transmits all white light incident from the WOLED. Thus, the W sub-pixel SPw may compensate for a decrease in image luminance that may be caused by the color filters RCF, GCF, and BCF.

In FIG. 3, 'E1' may be an anode electrode (or a cathode electrode), and 'E2' may be a cathode electrode (or an anode electrode). 'E1' is electrically connected to a driving thin film transistor (TFT) which is formed on a lower TFT array for each sub-pixel. The TFT array includes the driving TFT, at least one or more switching TFTs, and a storage capacitor for each sub-pixel, and is connected to the (see FIG. 1) data line DL and the gate line GL for each sub-pixel.

Referring back to FIG. 1, the data driver 120 converts four color compensation data Ro [n, x, y], Go [n, x, y], Bo [n, x, y] and Wo [n, x, y], whose chromaticity coordinates are compensated for, into an analog data voltage and supplies the compensation data to the data lines DL under the control of the timing controller (T_CON) 110, where 'n' represents a frame, and 'x' and 'y' represent a location of pixels to which color data is supplied.

The gate driver 130 generates a scan pulse under the control of the timing controller 110, and sequentially supplies the scan pulse to the gate lines GL, in order to select a horizontal line to which a data voltage is applied.

The timing controller 110 generates a data control signal DDC for controlling operation timing of the data driver 120 and a gate control signal GDC for controlling operation timing of the gate driver 130, based on timing signals, such as a vertical synchronization signal Vsync, a horizontal synchronization signal Hsync, a data enable signal DE and a clock signal CLK.

The timing controller 110 may include an RGB-to-RGBW converter 111. The RGB-to-RGBW converter 111 may receive three-color input data Ri [n, x, y], Gi [n, x, y], and Bi [n, x, y], which are input from outside, and supply four color output data Ro [n, x, y], Go [n, x, y], Bo [n, x, y], and Wo [n, x, y], whose chromaticity coordinates are converted, to the data driver 120. The RGB-to-RGBW converter 111 may be implemented in the data driver 120 or an additional chip, as determined according to applications.

Two different methods may be used to implement white color, when each sub-pixel included in a display panel is driven. That is, white color may be implemented by the white sub-pixel without having to use a color filter. Besides, white color may also be implemented by combining red, green, and blue colors which are implemented through an RGB color filter.

If the rate of implementing white color by using white sub-pixels increases, a driving load is concentrated on the white sub-pixel. Accordingly, the white sub-pixels may deteriorate rapidly and thus, the life of the pixel may be shortened. On the other hand, as the rate of implementing white color by using red, green, and blue sub-pixels increases, an electrical power consumption may be increased.

As the life cycle of the pixels and the electrical power consumption are in a trade-off relationship, it is required to determine an appropriate gain ratio (ga), which will be described later with respect to FIG. 5.

According to an embodiment of the present invention, a display device includes a data mapping unit and a gain adjustment unit. By determining a gain ratio to minimize a standard deviation value for output color data, power consumption may be decreased and a pixel with a long life cycle may be implemented. With regard to the operation of converting a chromaticity coordinate of three-color input data Ri [n, x, y], Gi [n, x, y], and Bi [n, x, y] into four color output data Ro [n, x, y], Go [n, x, y], Bo [n, x, y], and Wo [n, x, y], a detailed description is provided later.

FIG. 4 is a graph showing an operation of converting a chromaticity coordinate of three-color input data Ri, Gi, and Bi into four color output data Ro, Go, Bo, and Wo.

Figure 4A:
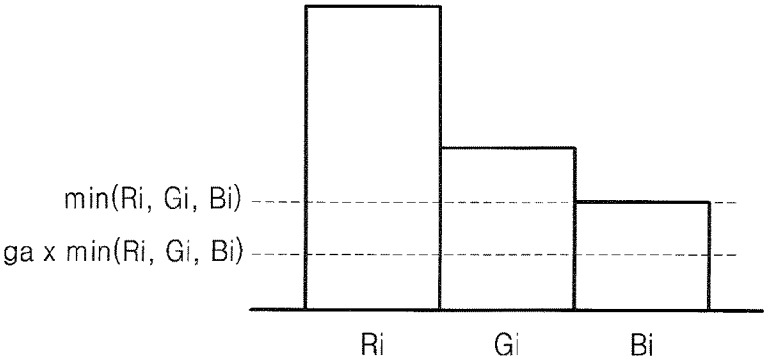
FIGS. 4A and 4B are graphs showing an operation of converting a chromaticity coordinate of three-color input data Ri, Gi, and Bi into four color output data Ro, Go, Bo, and Wo.
Figure 4B:
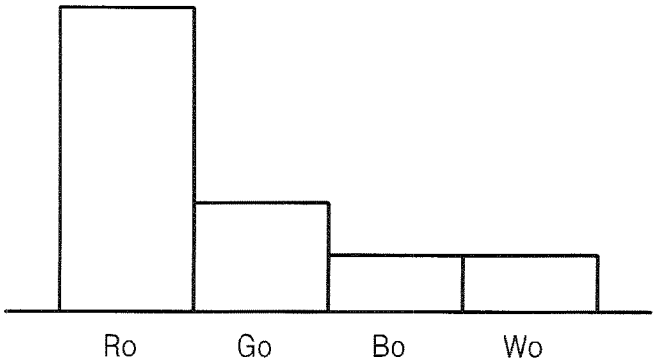

Referring to FIGS. 4A and 4B, an operation of converting a chromaticity coordinate of three-color input data RiGiBi into four-color output data RoGoBoWo may be done in the following order. First, a minimum value among three color input data Ri, Gi, and Bi is extracted. Next, the extracted minimum value is multiplied by a gain ratio to obtain white color output data. Then, the white color output data is subtracted respectively from three-color input data, to determine red, green, and blue color output data. The formula for obtaining the three-color output data is as follows:

$$Wo = ga \times \min[Ri, Gi, Bi] \quad \text{Formula 1}$$

$$Ro = Ri - Wo$$

$$Go = Gi - Wo$$

$$Bo = Bi - Wo,$$

where the gain ratio (ga) is higher than or equal to 0 and lower than or equal to 1.

Accordingly, if the gain ratio is high, the rate of implementing white color by using a white sub-pixel increases. If the gain ratio is low, the rate of implementing white color by using red, green, and blue sub-pixels increases.

The display device according to the present invention includes the data mapping unit and the gain adjustment unit. Thus, it is possible to determine the gain ratio to minimize a standard deviation value for output color data. Accordingly, power consumption may be decreased and a pixel with a long life cycle may be implemented.

Specifically, according to an embodiment of the present invention, the gain adjustment unit may change test gain ratios and calculate expected output data for red, green, blue, and white colors for each test gain ratio. Then, the gain adjustment unit may determine a test gain ratio, for minimizing a standard deviation for the calculated expected color output data, as a gain ratio of a corresponding pixel.

Figure 5:
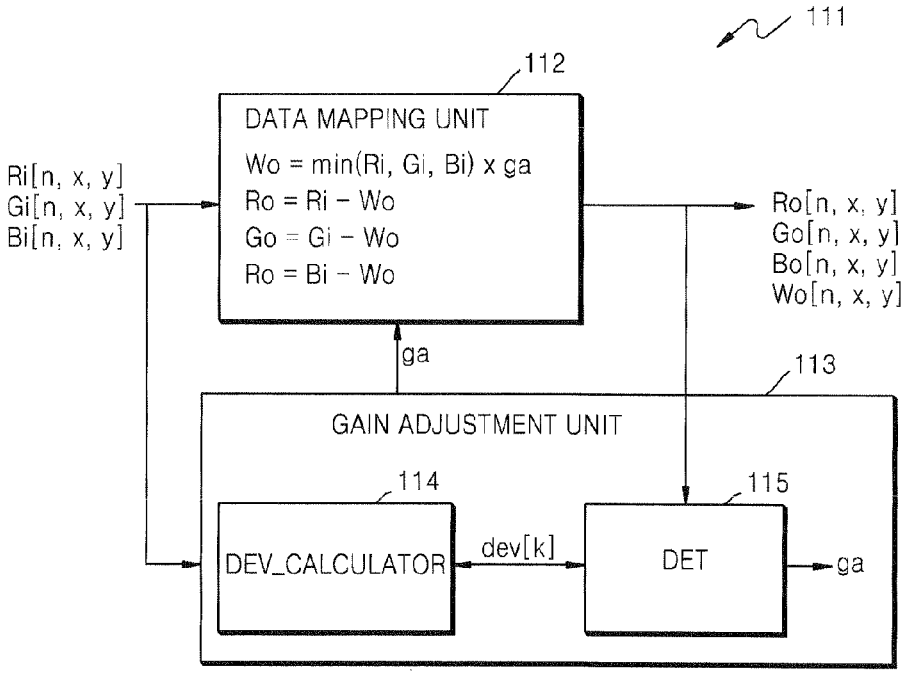
FIG. 5 is a diagram specifically illustrating an RGB-to-RGBW converter according to another embodiment of the present invention.

FIG. 5 is a diagram illustrating the RGB-to-RGBW converter 111 according to an embodiment of the present invention.

Referring to FIG. 5, the RGB-to-RGBW converter 111 includes a data mapping unit 112 and a gain adjustment unit 113.

The data mapping unit 112 receives three-color input data Ri [n, x, y], Gi [n, x, y], and Bi [n, x, y] and generates four color input data Ro [n, x, y], Go [n, x, y], Bo [n, x, y], and Wo [n, x, y]. The data mapping unit 112 receives a gain ratio from the gain adjustment unit 113 and uses the gain ratio to generate the four color input data Ro [n, x, y], Go [n, x, y], Bo [n, x, y], and Wo [n, x, y].

The gain adjustment unit 113 may include a deviation calculator (DEV_CALCULATOR) 114 and a comparator (DET) 115.

The DEV_CALCULATOR 114 may receive three-color input data Ri [n, x, y], Gi [n, x, y], and Bi [n, x, y] for locations of each pixel x and y for each frame n. The DEV_CALCULATOR 114 may calculate a standard deviation for expected output data for a test gain ratio (ga_test) and transmit the calculated standard deviation to the comparator (DET) 115. The comparator (DET) 115 may determine the test gain ratio (ga_test) which corresponds to a minimum value among the transmitted standard deviation as a gain ratio ga.

Figure 6:
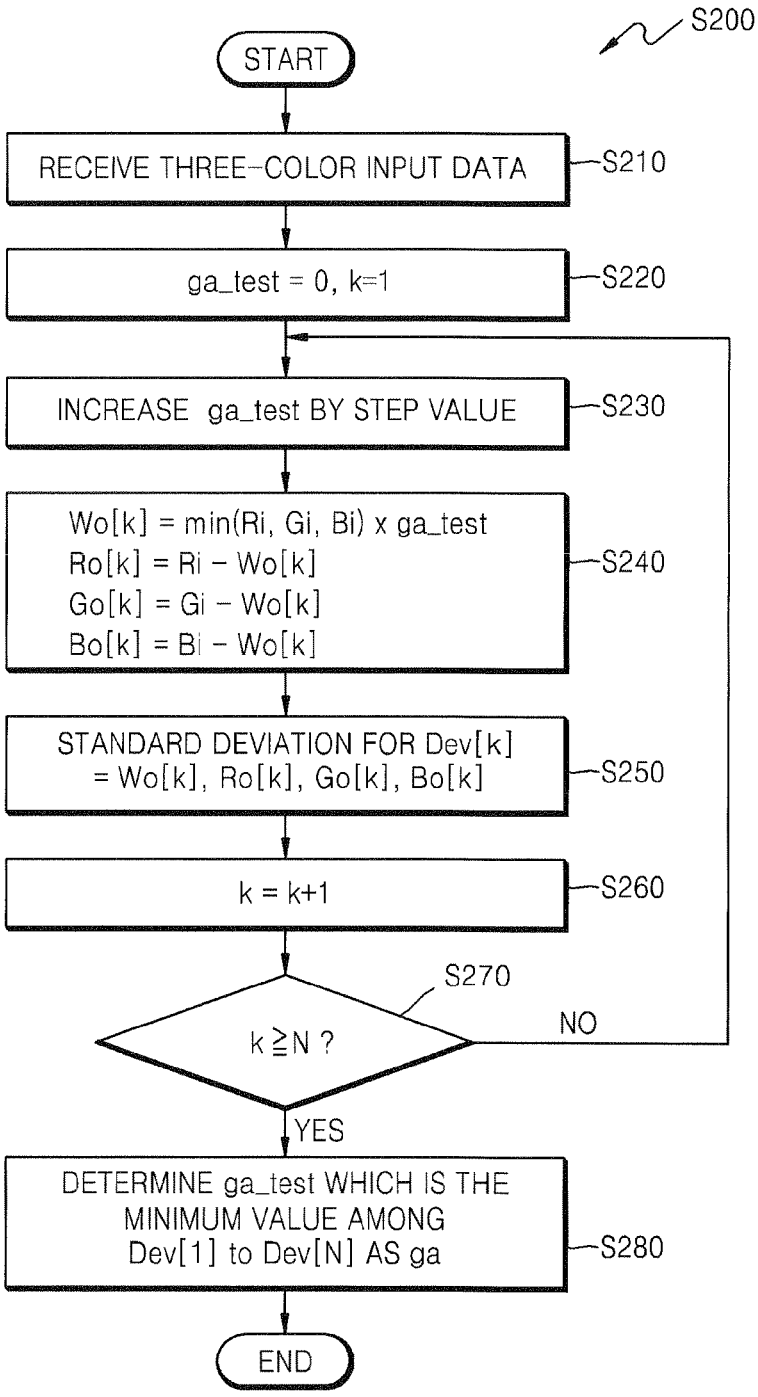
FIG. 6 is a flowchart illustrating an operation of a deviation calculator and a comparator according to an embodiment of the present invention.

FIG. 6 is a flowchart S200 for illustrating an operation of the DEV_CALCULATOR 114 and the comparator (DET) 115.

Referring to FIGS. 5 and 6, in operation S210, the DEV_CALCULATOR 114 may receive three-color input data Ri [n, x, y], Gi [n, x, y], and Bi [n, x, y]. In operations S230, S240, and S250, the DEV_CALCULATOR 114 may change a test gain ratio ga_test and calculate a standard deviation respectively for expected output data for Wo [k], Ro [k], Go [k], and Bo [k] for each test gain ratio ga_test, where k is a real value greater than or equal to 1.

In operation S260, the value of k is increased by one, and in operation S270 it is determined if k is greater than or equal to N. If not, the process keeps returning to operation S230 until k is determined to be greater than or equal to N, after which operation S280 is performed.

In operation S280, the comparator (DET) 115 may calculate a test gain ratio to minimize a standard deviation for the expected color output data Wo [k], Ro [k], Go [k], and Bo [k] and determine the calculated test gain ratio ga_test as a gain ratio ga.

The comparator (DET) 115 outputs the calculated gain ratio ga, and the gain adjustment unit 113 transmits the calculated gain ratio ga to the data mapping unit 112. The data mapping unit 112 executes RGB-to-RGBW conversion through the determined gain ratio ga. According to an embodiment of the present invention, the gain ratio ga is determined to obtain the lowest standard deviation for RGBW color output data used for a frame. Therefore, power consumption may be decreased and a pixel with a long life cycle may be implemented.

As mentioned above, a display device according to the present invention may be implemented to have a long life cycle with low power consumption by optimizing a trade-off relationship between a life cycle and power consumption.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A display device comprising:

a display panel comprising a plurality of unit pixels each comprising red, green, blue, and white sub-pixels;

a data driver supplying four color data signals, which correspond to red, green, blue, and white color output data, respectively to the plurality of unit pixels;

a gate driver supplying a gate-on voltage to the plurality of unit pixels; and a timing controller controlling driving of the data driver and the gate driver and supplies white color output data and red, green, and blue color output data of each sub-pixel to the data driver, the timing controller comprised of a data mapping unit:

extracting a minimum value among three-color input data which respectively correspond to red, green, and blue, determining white color output data by multiplying the extracted minimum value by a gain ratio, and determining red, green, and blue color output data respectively by subtracting the white color output data from the three-color input data; and a gain adjustment unit determining the gain ratio corresponding to a minimum standard deviation respectively for the white color output data and the red, green, and blue color output data.

2. The display device of claim 1, further comprised of the gain adjustment unit:

receiving the three-color input data, changing test gain ratios, determining expected color output data for red, green, blue, and white for each test gain ratio, obtaining a standard deviation for the determined expected color output data, and determining a test gain ratio to minimize for minimizing a standard deviation for determined expected color output data, as a gain ratio of a corresponding pixel.

3. The display device of claim 1, further comprised of the display panel displaying images which correspond to the white color output data and the red, green, and blue color output data.

4. A display device comprising:

a data mapping unit extracting a minimum value among three-color input data respectively corresponding to red, green, and blue data, determining white color output data by multiplying the extracted minimum value by a gain ratio, and determining red, green, and blue color output data respectively by subtracting the white color output data from the three-color input data; and a gain adjustment unit determining the gain ratio corresponding to a minimum standard deviation respectively for the white color output data and the red, green, and blue color output data.

5. The display device of claim 4, comprised of the gain adjustment unit determining a gain ratio for each unit pixel in display device.

6. The display device of claim 4, comprised of the gain adjustment unit determining gain ratios for each frame of displayed images.

7. The display device of claim 4, comprised of the gain adjustment unit receiving the three-color input data, changing test gain ratios, determining expected color output data for red, green, blue, and white for each of the test gain ratios, obtaining a standard deviation for the determined expected color output data, and determining test gain ratios to minimize standard deviation for the determined expected color output data for corresponding pixels.

8. The display device of claim 7, the test gain ratios being changed in the range from 0 to 1 by a step value.

9. The display device of claim 4, further comprising a unit pixel comprising red, green, blue, and white sub-pixels and a display unit displaying images corresponding to the white color output data and the red, green, and blue color output data.

10. A method of driving a display device comprising red, green, blue, and white sub-pixels, a gain adjustment unit, and a data mapping unit, the method comprising:

receiving, by the gain adjustment unit, three-color input data which respectively corresponding to red, green, and blue;

determining, by the gain adjustment unit, a gain ratio corresponding to a minimum standard deviation respectively for white, red, green, and blue color output data; and using the data mapping unit to convert the three-color input data which respectively correspond to red, green, and blue into four color input data which respectively correspond to white, red, green, and blue, through the determined gain ratio.

11. The method of claim 10, further comprised of the converting of three-color input data into four color input data comprising:

extracting a minimum value among the three-color input data which respectively correspond to red, green, and blue;

determining white color output data by multiplying the extracted minimum value by the gain ratio; and determining red, green, and blue color output data respectively by subtracting the white color output data from the three-color input data.

12. The method of claim 10, further comprised of displaying images which respectively correspond to the white color output data and the red, green, and blue color output data on a display panel.

13. The method of claim 10, further comprised of determining, by the gain adjustment unit, the gain ratios for each unit pixel comprised in a display panel.

14. The method of claim 10, further comprised of determining, by the gain adjustment unit, the gain ratios for each frame of displayed images.

15. The method of claim 10, further comprised of determining the gain ratio by changing test gain ratios and determining expected color output data respectively for red, green, blue, and white colors for each test gain ratio;

obtaining a standard deviation for the determined expected color output data; and determining a test gain ratio to minimize a standard deviation for the determined expected color output data, as a gain ratio of a corresponding pixel.

16. The method of claim 15, the test gain ratio being changed in the range from 0 to 1 by a step value.

* * * * *